US006116804A

United States Patent [19]

Mehta

[11] Patent Number: 6,116,804

[45] Date of Patent: Sep. 12, 2000

[54] BINDER SECURITY LOCK

[75] Inventor: Nandan R. Mehta, Arlington Heights, Ill.

[73] Assignee: Illinois Tool Works Inc., Glenview, Ill.

[21] Appl. No.: 09/412,968

[22] Filed: Oct. 5, 1999

[51] Int. Cl.[7] ..... B42F 13/20

[52] U.S. Cl. ..... 402/38; 24/67 R; 24/67.1; 24/67.5; 248/73; 281/27.2; 281/27.3; 281/28; 402/31; 402/37; 402/41; 402/63

[58] Field of Search ..... 281/27.1, 27.2, 281/27.3, 28; 402/2, 31, 32, 36, 37, 38, 39, 40, 41, 46, 63, 60; 24/67 R, 67.1, 67.5, 67.9, 67.11, 67 P, 901; 248/73

[56] References Cited

U.S. PATENT DOCUMENTS

| | | | |
|---|---|---|---|
| 3,015,869 | 1/1962 | Rapata . | |
| 3,098,489 | 7/1963 | Vernon . | |
| 3,098,490 | 7/1963 | Wance . | |
| 3,101,719 | 8/1963 | Vernon . | |
| 3,270,749 | 9/1966 | O'Connell | 402/36 |
| 3,884,586 | 5/1975 | Michaelis et al. . | |
| 4,566,817 | 1/1986 | Barrett, Jr. | 402/38 |
| 4,919,557 | 4/1990 | Podosek | 402/41 |
| 5,127,755 | 7/1992 | Bee . | |
| 5,354,142 | 10/1994 | Yu | 402/41 |
| 5,660,490 | 8/1997 | Warrington . | |
| 5,667,324 | 9/1997 | Aoki . | |
| 5,692,847 | 12/1997 | Zane et al. . | |
| 5,718,529 | 2/1998 | Chan . | |
| 5,967,690 | 9/1966 | Tibbetts | 402/73 |

*Primary Examiner*—Daniel W. Howell
*Assistant Examiner*—Monica S. Carter

[57] ABSTRACT

The rings of a loose leaf ring binder are selectively locked and unlocked by a locking member which travels within a slot on the spine of the ring binder. The leaf springs of the loose leaf ring binder have notches formed below a portion of the slot. Therefore, when a W-shaped locking prong of the locking member is aligned with the notches, the leaf springs can freely flex upwardly and downwardly allowing the rings of the loose leaf ring binder to open and close. However, when the W-shaped locking prong is not aligned with the notches, the W-shaped locking prong is urged against the leaf springs thereby maintaining the leaf springs in a downward position thereby locking the rings of the loose leaf ring binder in a closed position. The locking member further includes a locking tab to maintain the locking member within a locked position within the slot.

8 Claims, 8 Drawing Sheets

BINDER SECURITY LOCK

BACKGROUND OF THE INVENTION

1. Field of the Invention

This invention pertains to a locking member for locking the rings of a loose leaf ring binder so that the rings of the binder cannot be opened. A locking tab maintains the locking member in a locked position.

2. Description of the Prior Art

Loose leaf ring binders are well-established in the prior art. However, the rings of loose leaf ring binders frequently snap open at undesirable times. This can be accidental or intentional. An accidental opening can occur spilling the sheets of paper from the loose leaf ring binder, particularly if the ring binder is retaining more than the optimal number of sheets of papers. Additionally, such undesirable openings can be intentional, such as a customer at a store opening the rings of a ring binder of a store catalog and removing sheets from the ring binder.

One prior art solution has been to use a setscrew to constrain the leaf springs of the binder to a closed position. However, the cost of the setscrew, as well as the cost of installing the setscrew, has been high. Moreover, the installation and removal of the setscrew has required the use of a hex head wrench, which can be inconvenient.

U.S. Pat. No. 5,127,755 entitled "Binder with Security Lock Feature" and issued on Jul. 7, 1992 to Bee discloses a binder with a security lock feature including front and back cover panel connected by a spring and a page-holding mechanism attached to the spine on the inside of the binder for releasably holder pages in the binder. A security lock prevents the latching member from being moved to its release position.

U.S. Pat. No. 5,718,529 entitled "Ring Binder" and issued on Feb. 17, 1998 to Chan discloses a ring binder with a wire and lock element to lock the leaf springs of at least one of the pairs of half ring members while it is closed.

U.S. Pat. No. 5,692,847 entitled "Loose Leaf Binder Assembly and Spine Therefor" and issued on Dec. 2, 1997 to Zane et al. discloses a loose ring leaf binder assembly, including a spine with two long parallel rods spaced parallel from each other, with a spring biasing one of the rods into a down position.

U.S. Pat. No. 5,667,324 entitled "Binders" and issued on Sep. 16, 1997 to Aoki discloses a loose leaf binder wherein the lock members can engage each other when two strips are put together in the closed position.

However, this prior art either requires a substantial redesign of the standard loose leaf ring binder, is too costly or inconvenient, or does not directly address a loose leaf ring binder.

OBJECTS AND SUMMARY OF THE INVENTION

It is therefore an object of this invention to provide an apparatus for locking the rings of a loose leaf ring binder in a closed position.

It is therefore a further object of this invention to provide a locking apparatus for a loose leaf ring binder which does not require a substantial redesign of the loose leaf ring binder.

It is therefore a still further object of this invention to provide a locking apparatus for a loose leaf ring binder which can be intuitively engaged and disengaged while requiring a minimum of tools or difficult operations, while still maintaining the efficacy of the locking apparatus.

It is therefore a still further object of this invention to achieve the above objects while maintaining a low cost of manufacturing, shipping and installation.

These and other objects are attained by providing a loose leaf ring binder with the binder ring halves attached to leaf springs within a central spine. The spine includes typically two slots wherein a portion of the slots are formed over a notch formed on the leaf springs. A plastic locking member with a W-prong locking portion traverses from a first end of a slot to a second end of the slot. When the plastic locking member is located so that the W-prong locking portion is over the notch formed on the leaf springs, the leaf springs can freely flex upwardly and downwardly thereby allowing the binder rings to open and close. However, when the plastic locking member traverses to a position where the W-prong locking portion is away from the notch formed on the leaf springs, the leaf springs are constrained to a downwardly flexed position by contact with the W-prong locking portion thereby locking the binder rings in a closed position. The plastic locking member further includes a locking tab to semi-permanently lock the plastic locking member into this locked position.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
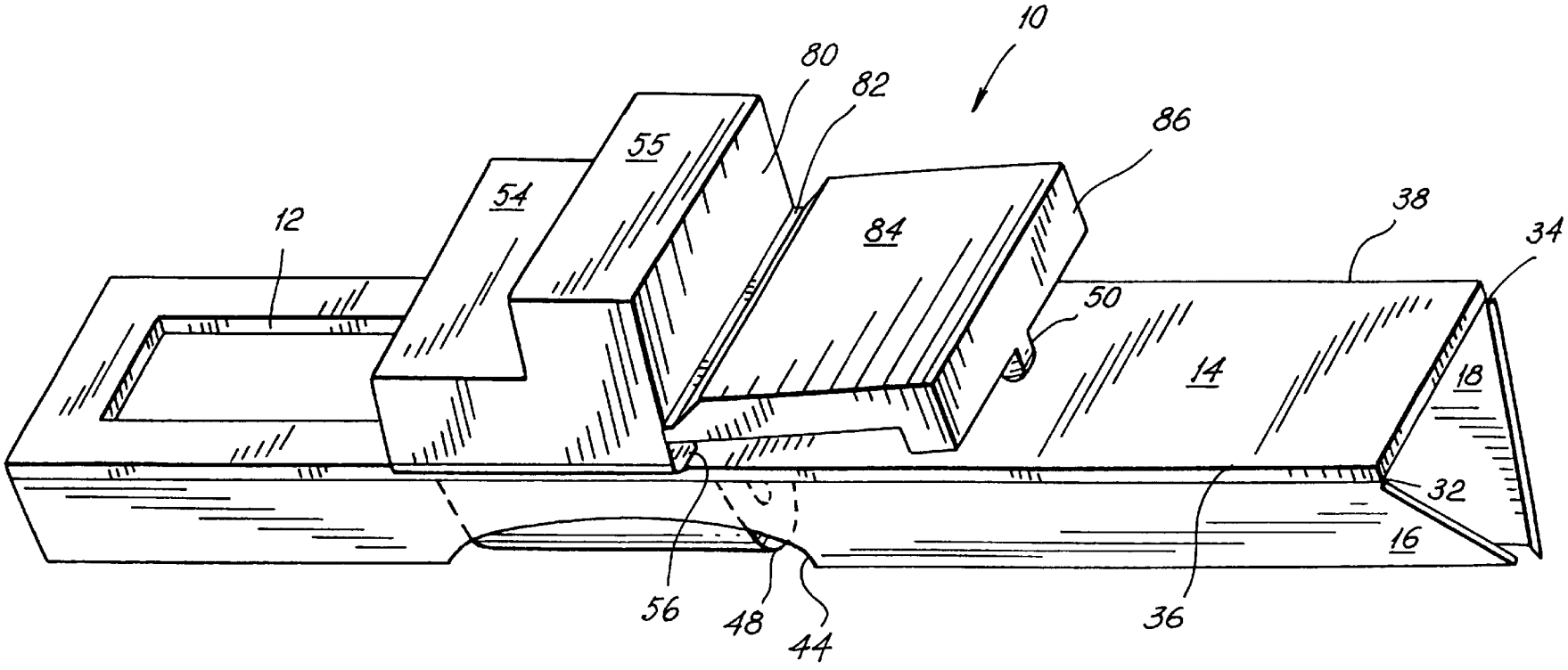
FIG. 1 is a perspective view of the unlocked position of the locking mechanism of the present invention, wherein the locking prong of the locking member is positioned over a notch in the leaf springs of the loose leaf ring binder, thereby allowing the binder rings to open and close without the leaf springs engaging or being constrained by the locking prong.
Figure 2:
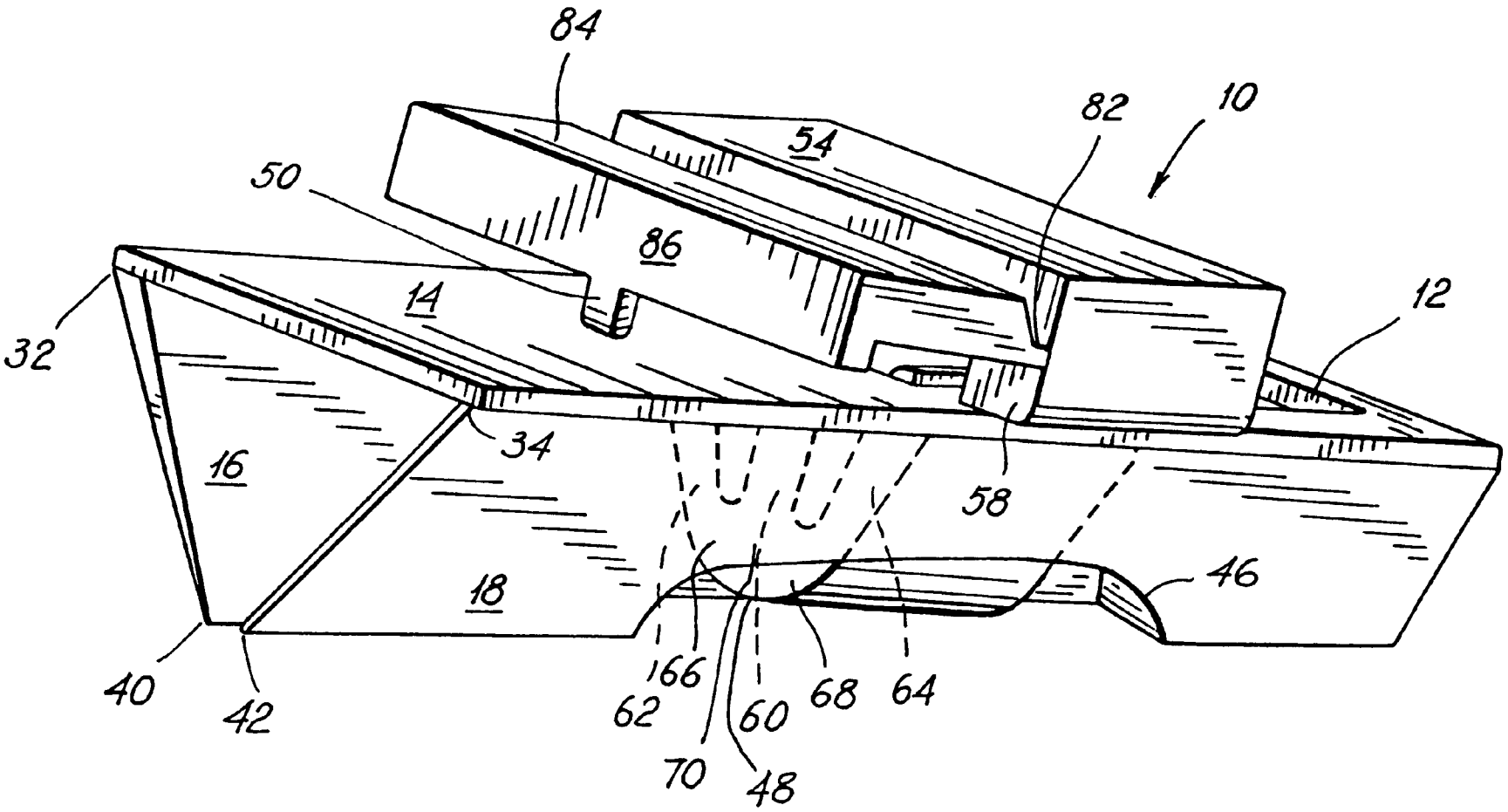
FIG. 2 is a perspective view of the unlocked position of the locking mechanism of the present invention, similar to FIG. 1, but from a lower angle thereby showing detail of the locking prong.
Figure 3:
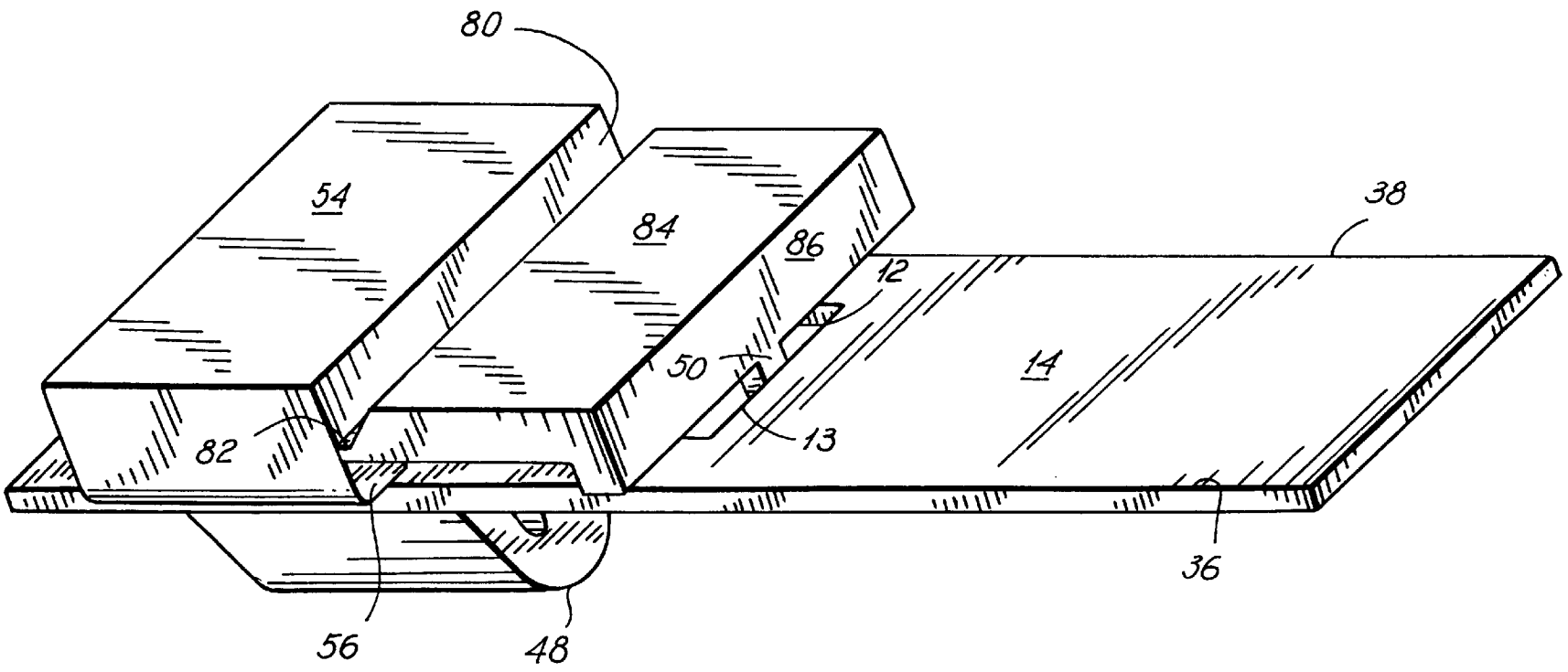
FIG. 3 is a perspective view of the locked position of the locking mechanism of the present invention.
Figure 4:
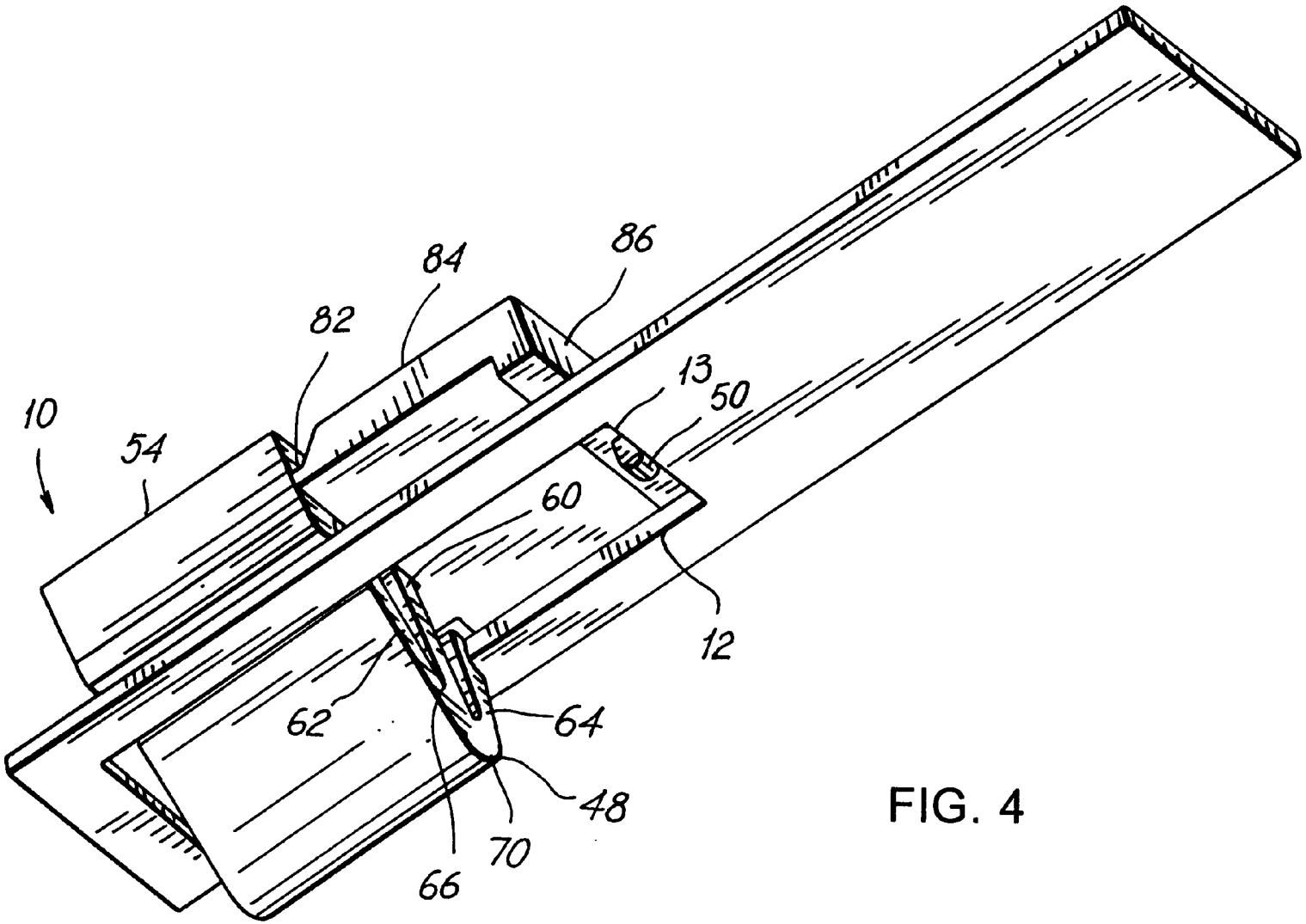
FIG. 4 is a lower perspective view of the locked position of the locking mechanism of the present invention.

Referring now to the drawings in detail wherein like numerals refer to like elements throughout the several views, one sees that FIG. 1 is a front perspective view of locking member 10 engaged within slot 12 of loose leaf ring binder spine 14 in the unlocked position, but with the rings of the loose leaf ring binder in a closed position. Leaf spring 16 is engaged to binder ring halves 20, 24, 28 while leaf spring 18 is engaged to binder ring halves 22, 26, 30 (see FIG. 8). Leaf springs 16, 18 include outward edges 32, 34 which remain roughly in place with respect to lateral edges 36, 38 of loose leaf ring binder spine 14 while inward edges 40, 42 of leaf springs 16, 18 flex upwardly to separate binder ring halves 20, 24, 28 from binder ring halves 22, 26, 30 so that the rings of the loose leaf ring binder are in the open position. Likewise, inward edges 40, 42 are illustrated in the downward position in FIG. 1, typical of binder ring halves 20, 24, 28 being engaged against binder ring halves 22, 26, 30 so that the rings of the loose leaf ring binder are in the closed position. Leaf springs 16, 18 further include notches 44, 46 on inward edges 40, 42 which are laterally aligned with each other and positioned below substantially one half of slot 12. Therefore, when W-prong portion 48 of locking member 10 is positioned over notches 44, 46 as shown in FIGS. 1 and 2, this allows inward edges 40, 42 of leaf springs 16, 18 to flex upwardly without engaging, abutting or otherwise being constrained by W-prong portion 48 thereby allowing binder ring halves 20, 24, 28 to separate from binder ring halves 22, 26, 30 thereby opening the rings of the loose leaf ring binder. However, when locking member 10 is moved to a position away from notches 44, 46, such as the position shown in FIGS. 3 and 4, W-prong portion 48 of locking member 10 abuts leaf springs 16, 18 and maintains leaf springs 16, 18 in a downward position thereby locking binder ring halves 20, 24, 28 to binder ring halves 22, 26, 30 thereby locking the loose leaf ring binder. Additionally, locking tab 50, which may further include a distal upwardly hooking portion 51 (see FIG. 7), engages end 13 of slot 12 thereby maintaining the locking member 10 semi-permanently within the position illustrated in FIGS. 3 and 4 thereby increasing the difficulty of moving the locking member 10 from a locked position to an unlocked position.

Figure 5:
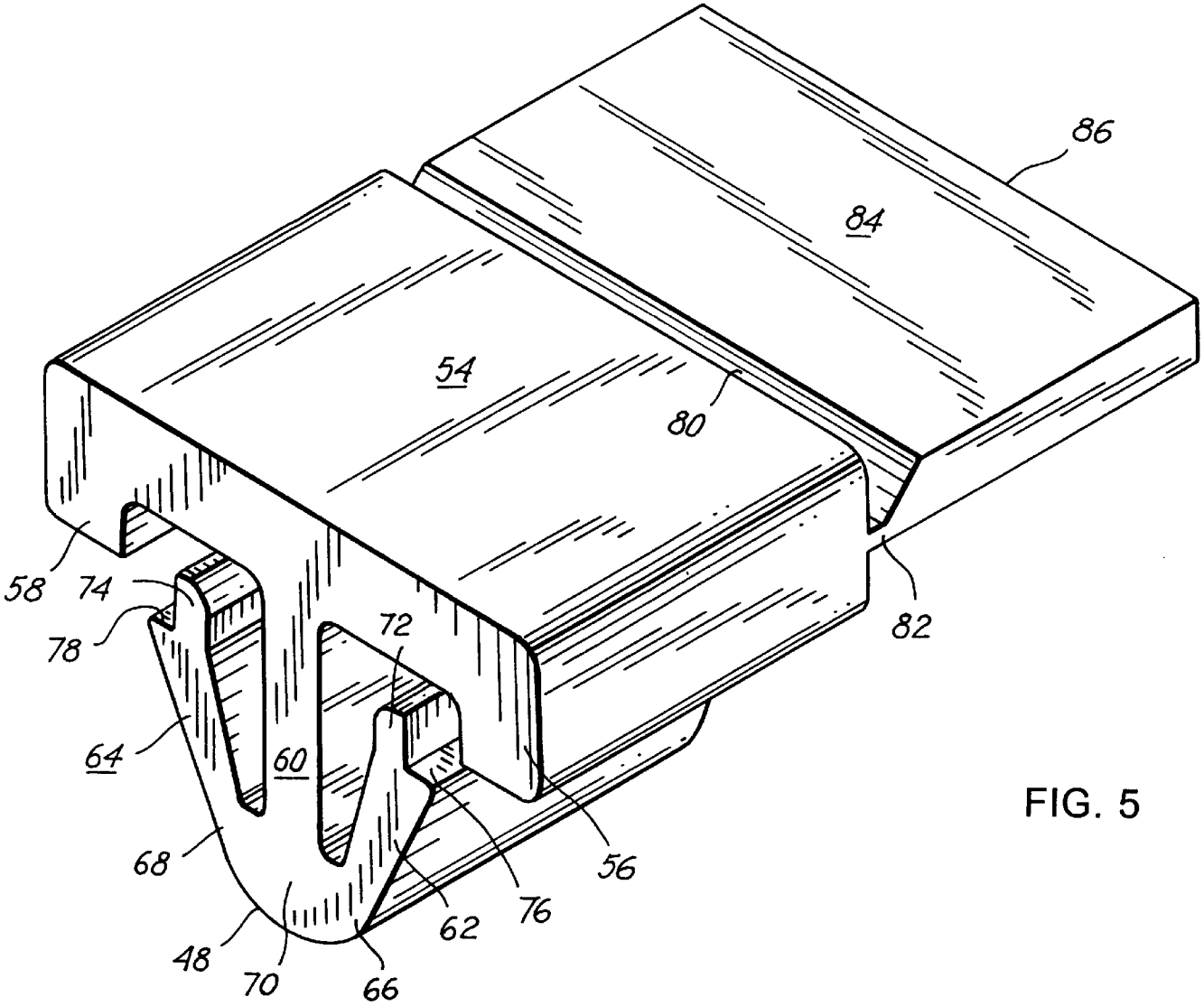
FIG. 5 is a front perspective view of the locking member of the present invention.
Figure 6:
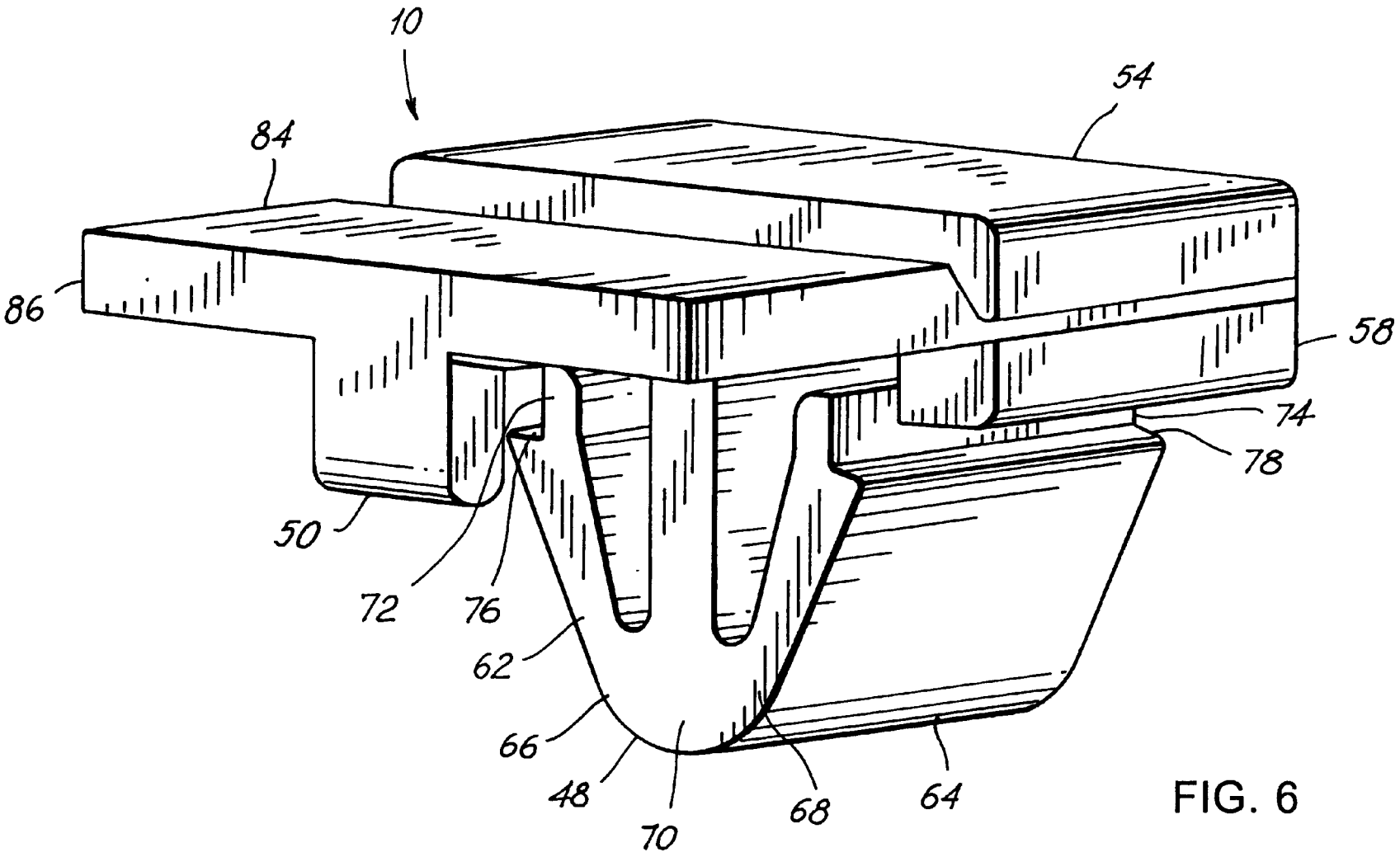
FIG. 6 is a rear perspective view of the locking member of the present invention.
Figure 7:
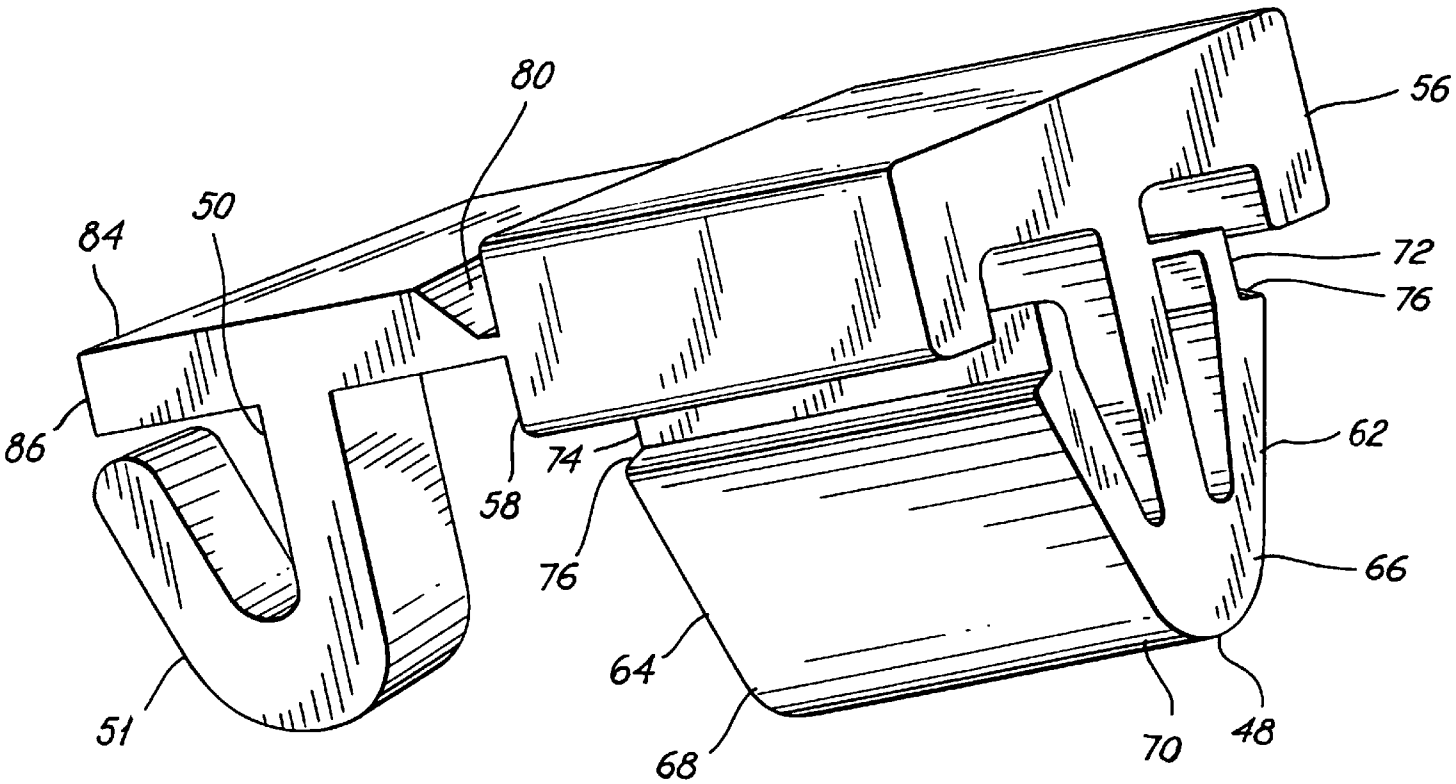
FIG. 7 is a front perspective view of the locking member of the present invention, similar to FIG. 5, but from a somewhat lower angle thereby showing detail of the locking prong, and further including the distal upwardly hooking portion of the locking tab.
Figure 8:
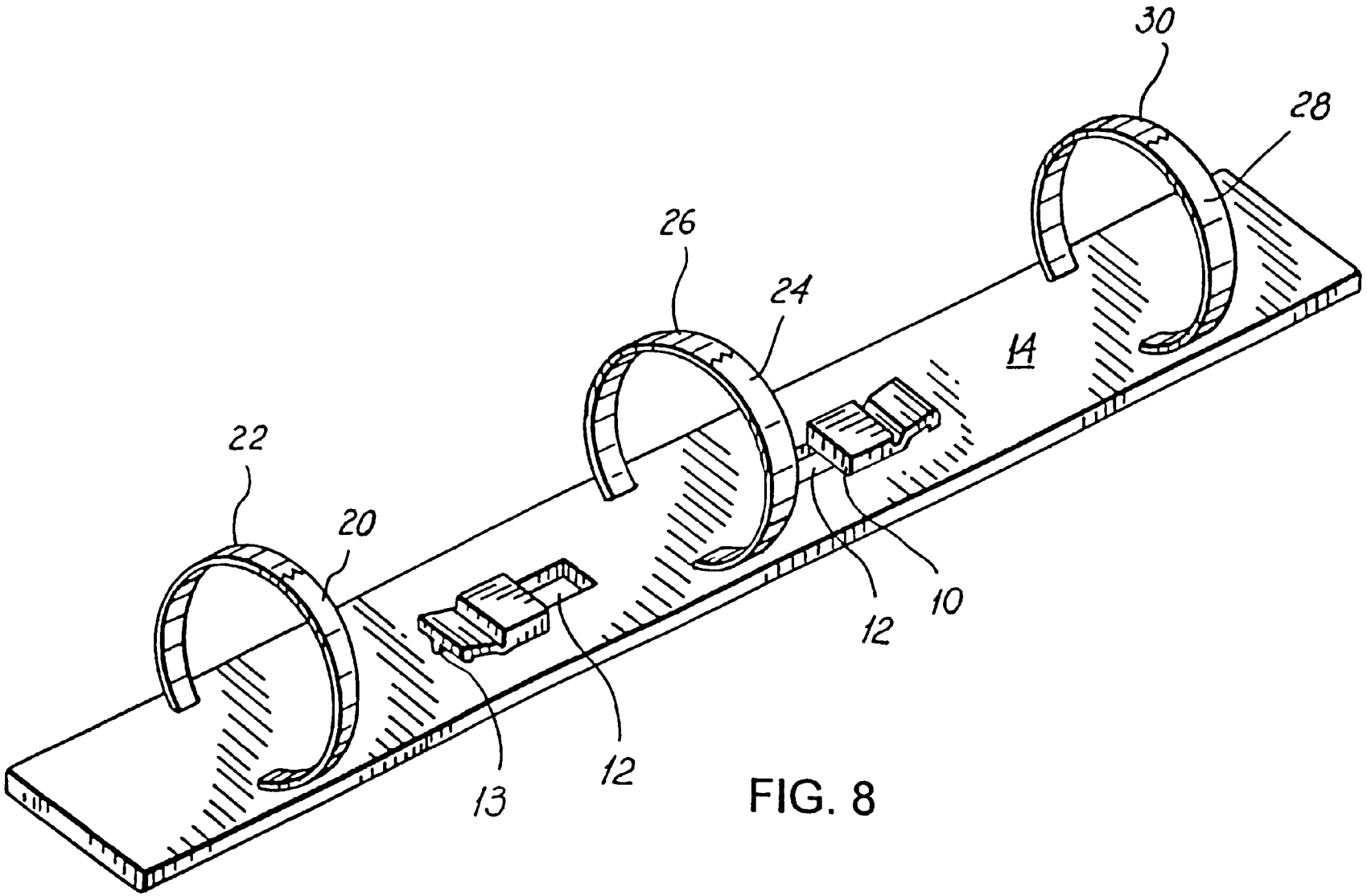
FIG. 8 is a perspective view of the spine of a loose leaf binder of the present invention, showing the locking members in an unlocked position.

Further detail of locking member 10 is illustrated in FIGS. 5, 6 and 7. Locking member 10 includes a relatively stiff planar body 54 with downwardly turned lateral edges 56, 58 to slidingly engage loose leaf ring binder spine 14. FIG. 1 illustrates optional raised portion 55 on otherwise planar body 54. Raised portion 55 facilitates gripping by a user during the sliding of locking member 10 within slot 12. W-prong portion 48 is formed from downwardly extending central stem 60 and upwardly extending diagonal arms 62, 64. Proximal ends 66, 68 of upwardly extending diagonal arms 62, 64 are integral with lower end 70 of downwardly extending central stem 60. Distal ends 72, 74 of upwardly extending diagonal arms 62, 64 include outwardly directed lateral channels 76, 78 for slidingly engaging an edge of slot 12 of loose leaf ring binder spine 14. This configuration further allows W-prong portion 48 to be easily inserted into slot 12 of loose leaf ring binder 14 by upwardly extending diagonal arms 62, 64 flexing inwardly during insertion, and arms 62, 64 subsequently flexing outwardly to maintain locking element 10 within slot 12 and resist withdrawal therefrom.

Rearward surface 80 of planar body 54 includes living hinge 82 which further engages rearward planar section 84. Distal edge 86 of rearward planar section 84 includes locking tab 50 which may further include distal upwardly hooking portion 51 (see FIG. 7). Locking tab 50 engages end 13 of slot 12 thereby maintaining locking member 10 within a locked position. This function is enhanced by distal upwardly hooking portion 51 engaging an underside of loose leaf ring binder spine 14.

The manufacture of the locking member 10 and related elements is extremely simple. Locking member 10 is typically integrally formed by a plastic molding process. Likewise, the only modification required to the loose leaf ring binder is the formation of slot 12 within loose leaf ring binder spine 14 and the formation of notches 44, 46 on inward edges 40, 42 of leaf springs 16, 18.

The installation of locking member 10 is simply the insertion of locking members 10 into slots 12, and the eventual sliding of locking members 10 into the locked position with slots 12 and the insertion of locking tabs 50 within slots 12.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A locking apparatus for leaf springs of a ring binder, including:

a slot formed on a spine of the ring binder;

at least one notch formed in the leaf springs, said at least one notch being aligned with a portion of said slot;

a locking member slidably engaging said slot between a first position wherein the leaf springs are locked in position and a second position wherein the leaf springs are free of locking, and further including a downwardly extending locking prong, wherein said downwardly extending locking prong engages the leaf springs in said first position, and wherein said downwardly extending prong aligns with said at least one notch in the leaf springs in said second position whereby said leaf springs can move substantially free of engagement with said downwardly extending locking prong; and said locking member further including means for locking said locking member in said first position within said slot.

2. The locking apparatus of claim 1 wherein said means for locking said locking member includes a locking tab on said locking member for engaging an end of said slot.

3. The locking apparatus of claim 2 wherein said locking member includes a generally planar body traveling outside of said slot, and said downwardly extending locking prong includes a stem downwardly extending from said generally planar body through said slot and two arms extending upwardly from a lower end of said stem to slidingly engage lateral edges of said slot.

4. The locking apparatus of claim 3 wherein said arms include proximal ends which are integral with said lower end of said stem and distal ends which slidingly engage lateral edges of said slot.

5. The locking apparatus of claim 4 wherein said distal ends include lateral channels for slidingly engaging lateral edges of said slot.

6. The locking apparatus of claim 5 wherein said generally planar body includes downwardly turned lateral edges for slidingly engaging the spine of the ring binder.

7. The locking apparatus of claim 6 further including a rearward planar section on which said locking tab is formed and further including a living hinge joining said rearward planar section and said generally planar body.

8. The locking apparatus of claim 7 wherein said locking tab includes a distal upwardly hooking portion.

* * * * *